US007389658B2

(12) United States Patent
Søberg

(10) Patent No.: US 7,389,658 B2
(45) Date of Patent: Jun. 24, 2008

(54) APPARATUS FOR CLEANING A LOCAL AREA OF A FABRIC

(76) Inventor: Jesper Søberg, Ubberudgårdvej 6, Ubberud, DK-5491 Blommenslyst (DK) 5491

( * ) Notice: Subject to any disclaimer, the term of this patent is extended or adjusted under 35 U.S.C. 154(b) by 594 days.

(21) Appl. No.: 10/506,189

(22) PCT Filed: Feb. 12, 2003

(86) PCT No.: PCT/DK03/00089

§ 371 (c)(1),
(2), (4) Date: Sep. 1, 2004

(87) PCT Pub. No.: WO03/074775

PCT Pub. Date: Sep. 12, 2003

(65) Prior Publication Data

US 2005/0166642 A1 Aug. 4, 2005

(30) Foreign Application Priority Data

Mar. 1, 2002 (DK) ..... 2002 00322

(51) Int. Cl.
*D06F 37/00* (2006.01)

(52) U.S. Cl. ..... 68/5 A; 68/200; 68/205 R; 68/240

(58) Field of Classification Search ..... 68/5 A, 68/200, 213, 235 R, 240, 205 R; 401/10, 401/183

See application file for complete search history.

(56) References Cited

U.S. PATENT DOCUMENTS

| | | | | |
|---|---|---|---|---|
| 656,802 | A * | 8/1900 | Batz | 68/213 |
| 970,069 | A | 9/1910 | Malmros et al. | |
| 1,892,792 | A | 1/1933 | Thompson | |
| 2,254,691 | A * | 9/1941 | MacLelland, Jr. | 68/5 A |
| 2,301,227 | A * | 11/1942 | Pickett, Jr. et al. | 68/20 |
| 2,552,853 | A * | 5/1951 | Isserstedt | 68/213 |
| 5,402,657 | A | 4/1995 | Henry, Jr. | |
| 5,707,163 | A * | 1/1998 | Gregory | 401/10 |
| 7,225,502 | B2 * | 6/2007 | Shenouda | 15/320 |

FOREIGN PATENT DOCUMENTS

| | | |
|---|---|---|
| JP | 07 100288 A | 8/1995 |
| WO | WO97 06723 A | 2/1997 |

* cited by examiner

*Primary Examiner*—Joseph L. Perrin
(74) *Attorney, Agent, or Firm*—James Creighton Wray; Clifford D. Hyra

(57) ABSTRACT

An apparatus for cleaning a fabric or other sheet-like porous material. The apparatus comprises a manually driven pump for pumping a cleaning substance through a local area of the material. The pump further comprises an elastic member with a force acting oppositely to the direction of the manual pumping action.

17 Claims, 9 Drawing Sheets

Figure 1A:
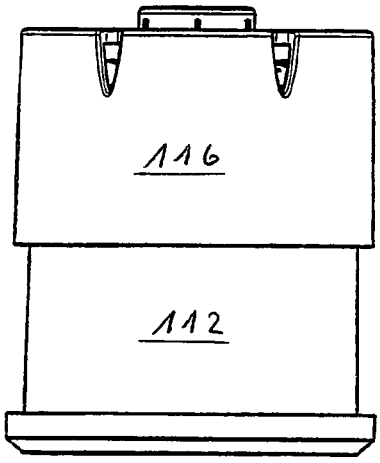

FIG. 4b
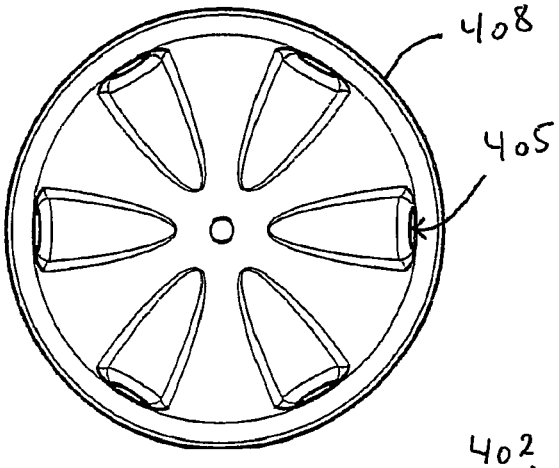
FIG. 4a
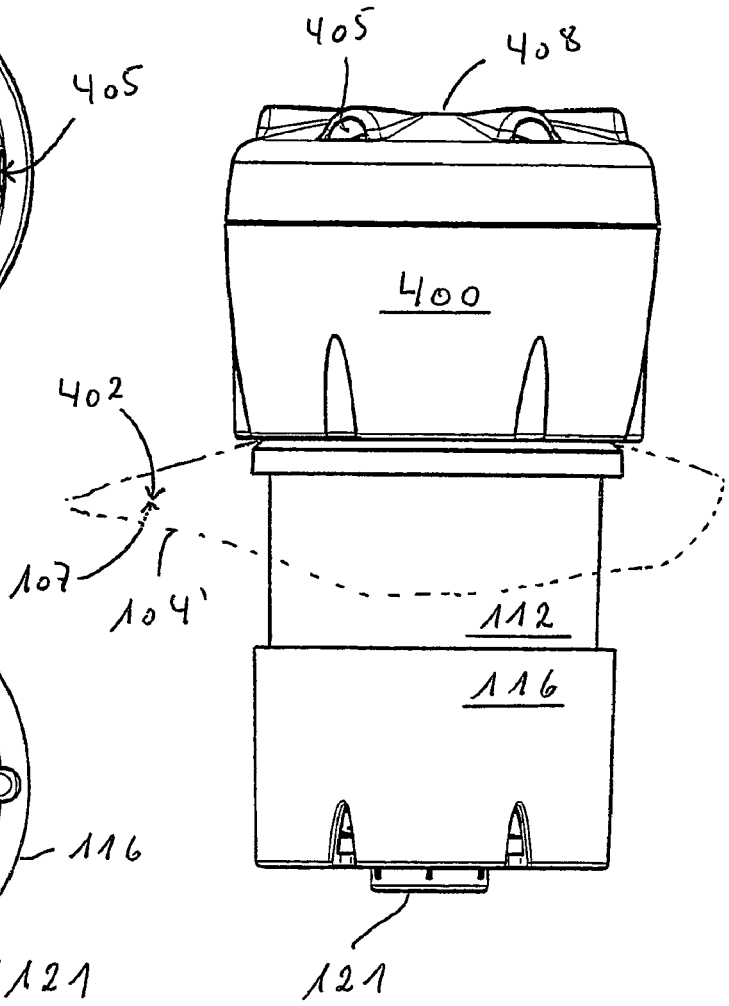
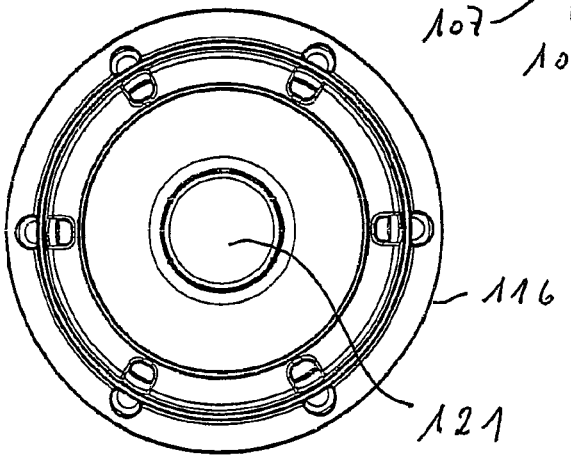
FIG. 4c

APPARATUS FOR CLEANING A LOCAL AREA OF A FABRIC

This application claims the benefit of Danish Application No. 2002 00322 filed Mar. 1, 2002 and PCT./DK03/00089 filed Feb. 12, 2003.

FIELD OF THE INVENTION

The invention concerns an apparatus for cleaning a fabric or other sheet-like porous material. The apparatus comprises a manually driven pump for pumping a cleaning substance through a local area of the material.

BACKGROUND OF THE INVENTION

In order to remove stains on clothes or other fabrics, it is common practice to apply efficient cleaning agents with a certain risk for discolorations of the fabric. Usually, the treatment implies that a region on the fabric is treated that is much larger than the size of the stain, which is unwanted.

From U.S. Pat. No. 656,802 by Batz, a grease spot remover is disclosed comprising a pump having a reservoir chamber communicating with the pump-chamber and means for clamping the two chambers together. A cleaning agent may be pumped back and forth between the two chambers in order to clean the area of interest. The disclosed clamping means are wires that are needle pointed through the fabric and connected to the two chambers. This results in holes through the fabric, which in many cases are unwanted, especially in clothes of fine quality. The grease spot remover also is generally not very handy as the manual pumping action has to be performed under the fabric to be cleaned such that a simple resting against an underlying surface is not possible. Also, the pumping needs a pulling action and a pushing action, which makes the use of it tedious as at the same time the upper chamber has to be held vertically in order not to spill the liquid. Furthermore, the drawn embodiments are of a format, which does not make them suitable to transport in a hand bag or during travel. Therefore, needs exist for improvements.

SUMMARY OF THE INVENTION

An improved apparatus for cleaning a material, the material being a fabric or other porous material, is provided as set forth in the claims. The apparatus comprises a manually driven pump for pumping a cleaning substance through a local area of the material. The pump comprises a first reservoir with an opening for communication with a local area of a first side of the porous material. The reservoir has a first volume in a deactivated state of the pump and is constructed with a variable volume for pumping of the cleaning substance through the local area of the material upon manual activation of the pump. Furthermore, the pump comprises an elastic member with force acting on the first reservoir to attain the first volume in the first reservoir.

The apparatus may be configured for a manual pushing pump action or a pulling pump action. Whether the former or latter is employed, depends on the desired properties. However, in many cases, a push action may be preferred, where the elastic member counteracts the pushing action with the change of the volume of the first reservoir, such that the first volume of the deactivated state is attained again after the force of the pushing action is relieved. In the following, the invention will be explained with a manual pushing pump action, though it will be apparent to the skilled in the art, how a modification has to be performed to employ the invention with a manual pulling pump action.

Having an elastic member as described and the pump configured for a push action to achieve the pumping, the apparatus according to the invention has the advantage that it may be used with only one hand and by performing a very simple movement of the hand during the push action. Due to its very simple use, the apparatus according to the invention is extraordinarily user friendly.

The apparatus according to the invention may be used for cleaning in the following way assuming that the apparatus requires a pushing pumping action in order to change the volume of the first reservoir from the deactivated state. Once a stain or spot has been observed, for example on the fabric of an arm chair, a cleaning fluid is put on the spot, and the apparatus according to the invention is arranged to cover the spot by resting the rim of the opening of the first reservoir against the fabric. By performing a manual pushing pump action, air is pressed out of the first reservoir and into the fabric. Thereby, the cleaning fluid is pumped through the fabric. When the pressure for the pushing action is relieved, the elastic member causes a pull back of air into the first reservoir by which the cleaning fluid is pulled through the fabric. By pressing the cleaning fluid back and forth through the fabric, the spot is removed. Especially, a foam may be produced by this action, which may improve the cleaning process.

In a most simple embodiment, the pump comprises a resilient bellow closed in one end and open at the other end with a rim for communication with the material, In this case, the internal volume of the bellow comprises the first reservoir. Another simple embodiment is achieved in that the pump comprises a resilient polymer container having an opening for communication with the fabric or other sheet-like porous material, the internal volume of the polymer container comprising the first reservoir.

However, preferred is a certain embodiment, wherein the first reservoir has a boundary in a first reservoir-chamber, the boundary comprising a cylindrical or substantially cylindrical inner wall of the first reservoir-chamber and a piston closely fitting to the inner wall, where a displacement of the piston varies the volume of the first reservoir.

The inner wall may be truly cylindrical, where the term cylindrical does not necessarily imply that the inner wall is circular in cross section. However, the piston may be provided with an elastically fitting sealing such that a perfect cylindrical wall is not necessary. Substantially cylindrical, in this case, means a shape that for practical purposes in connection with the piston and an eventual sealing appears cylindrical. However, as the reservoir-chamber may be produced by injection moulding with polymers, it is of advantage that the inner wall of the reservoir-chamber is slightly conical such that the chamber easily can be released from the mould form.

In case that the inner wall is not perfectly cylindrical but only substantially cylindrical, for example slightly conical due to the reasons mentioned above, the piston may be equipped with a resilient sealing for fitting closely to the inner wall. Such sealing rings may be made of rubber. However, it has turned out that this is not an optimum choise, as rubber shows a high friction with the typical materials, for example polymer or metal, used for the inner wall. Furthermore, it is not inert to a degree as high as desired when certain cleaning agents are used. Even further, such material is not long lasting for the purpose of concern and may already after relatively short time stop working properly as a sealing. Therefore, it is preferred that the sealing comprises a low friction, inert sealing ring having a smooth outer side abutting the inner wall and an alternating thickness variation in its longitudinal direction for easing the elastic change of length of the inert sealing ring.

In this embodiment, it is possible to use inert, low friction materials as PTFE also known as Teflon®. Even more preferred is a blend of polytetrafluorethylen with polyoxymethylene-acetal-polymer (POM) which can be used for moulding being a cheap and production friendly solution. In the following the term PTFE-ring is used for a ring made of polytetrafluorethylen—PTFE—or alternatively of polytetrafluorethylen with polyoxymethylene-acetal-polymer—PTFE (POM)

Inert materials as PTFE and PTFE(POM) are normally not very elastic as compared to rubber rings, but may be preferred due to the low friction with the inner wall and due to its inert properties in connection with cleaning fluids and due to its long lasting performance even after long time of dry storage. In order to achieve sufficiently elastic properties, parts of the inert, low friction sealing ring are thin such that a certain stretching and compression of it is possible. By having an alternating thickness such that the inert, low friction sealing ring is thicker between the thin sections, it is in addition assured that it does remain in a groove of the piston without the risk of sliding out of the groove under even intensive pumping action.

Furthermore, the inert, low friction sealing ring may be supported in a groove of the piston by a resilient o-ring exerting force on the sealing ring in a direction towards the inner wall. As the sealing ring is not as elastic as rubber or, for example, silicone, an o-ring support of the sealing ring combines the low friction, inert and tightening capabilities with the resilient properties of a rubber o-ring. The alternating thickness variation of the inert, low friction sealing ring allows the o-ring to be more elastically deformed, because material may be displaced from the elastic o-ring into the grooves of the thin sections of the sealing ring during the deformation of the o-ring under compression. Therefore, the alternating thickness of the inert, low friction sealing ring serves a number of purposes.

As the inert, low friction sealing ring has an alternating thickness, it may occur that the sealing is not completely tight between the sealing ring and the o-ring in the groove. An improvement may thus be achieved by providing the sealing ring with a sealing lip following the inner side of the sealing ring along its longitudinal direction and abutting the o-ring.

In a practical embodiment, the elastic member, for example a spring, is arranged between the piston and the first reservoir-chamber for actuating the piston towards the deactivated state.

In a further embodiment, the piston is connected to an outer housing, configured to be able to enclose the first reservoir-chamber under storage conditions. In addition, the outer housing may comprise a cavity accessible from the outside of the housing. Such a cavity may be used for containing a releasable container for cleaning fluid, such that the apparatus according to the invention constitutes a kit with the cleaning device and the necessary cleaning fluid, for example a fluid with enhanced foaming properties.

When foam is pressed through a porous material, the flow of air and foam through the material at the centre of the volume changing reservoir resting against the material is usually not the same as the flow at the rim of the reservoir. In this case, the following embodiment of the invention is useful, where the apparatus comprises a cover unit configured to sealingly cover the opening of the first reservoir, the cover unit having apertures for communication between the first reservoir and the local area of the material. The apertures may be constructed in accordance with desired flow properties. For example, the apertures may have a width that increases with distance from the centre of the cover unit. In this case, a flow is achieved through the material, where the central flow and the flow at the rim are of the same order.

However, it may be desirable that not only air and foam may be pressed through the material, for example a fabric, but it may as well be desirable to press water through the fabric in order to flush the cleaning fluid out of the material. Eventually, it may be desirable to press a larger amount of cleaning fluid, for example water with a grease dissolving agent, through the material. In these cases, it is of advantage that the apparatus comprises a second reservoir-chamber with an opening for communication with the local area at the opposite side of the material, the second reservoir-chamber having apertures for allowing escape of air from the second reservoir chamber, wherein the rims of the openings of the first and the second reservoir-chambers are configured to mutually correspond for creating a substantially fluid tight connection between the first and the second reservoir chamber when the material is placed between the rim of the first reservoir-chamber and the corresponding rim of the second reservoir-chamber.

This embodiment may be used in the following way. Water, eventually with a cleaning agent, is filled into the first reservoir having the opening directed upwards. The housing with the filled first reservoir is placed on a platform, for example a table, and fabric or other porous material is placed on the rim of the opening of the first reservoir with the corresponding stain on the material within the periphery of the rim. Then, the second reservoir chamber is placed on the upper side of the porous material with its rim fittingly arranged in the rim of the first reservoir-chamber. By now pushing the second reservoir chamber downwards, the liquid from the first reservoir is pressed through the porous material and into the second reservoir. When the pushing force is released, the elastic member presses the chambers back into the deactivated state, such that the fluid is sucked back into the first reservoir. Due to the elastic member, for example a spring, a tight connection between the two chambers is retained. As the rims of the first and the second reservoir correspond, a liquid tight connection is achieved in combination with the porous material. The embodiment is therefore an easy-to-use cleaning apparatus.

In order to achieve an optimum tight connection on both sides of the porous material, it may be of advantage—especially if the porous material is not very flexible—if the rim of the first reservoir-chamber or the rim of the second reservoir-chamber or both of them are provided with a resilient collar.

In a further embodiment, the second reservoir-chamber is configured for storage conditions to receive the outer housing enclosing the first reservoir-chamber. This embodiment is suited as a first-aid in cleaning under travel conditions, because the apparatus according to this embodiment of the invention can be stored in a very compact way. In order to secure that the stored housing does not fall out of the second reservoir chamber under storage conditions, the second reservoir-chamber may be provided with a detachable lid for in detached configuration to allow receipt of the outer housing and under storage conditions with attached lid to cover the received housing.

SHORT DESCRIPTION OF THE DRAWING

Figure 1B:
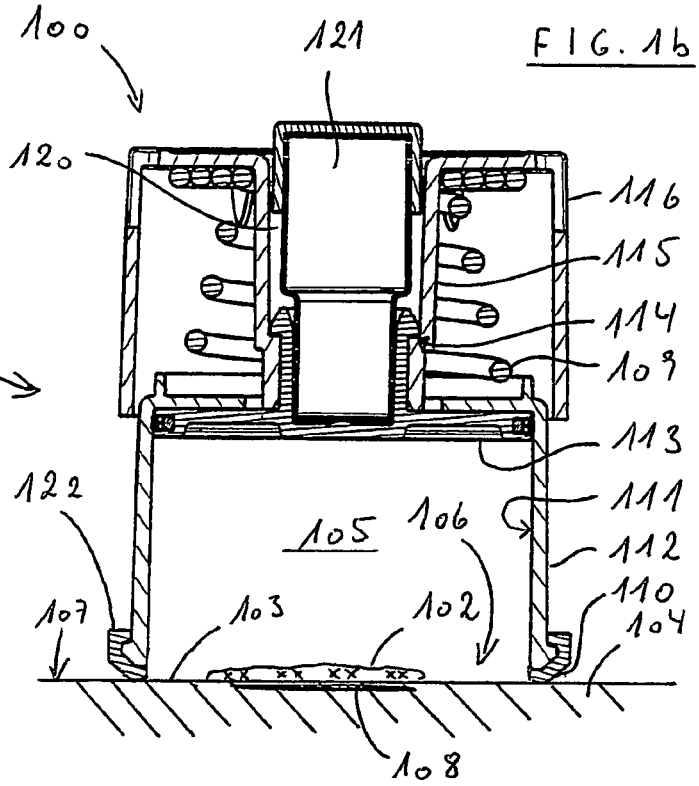
Figure 1C:
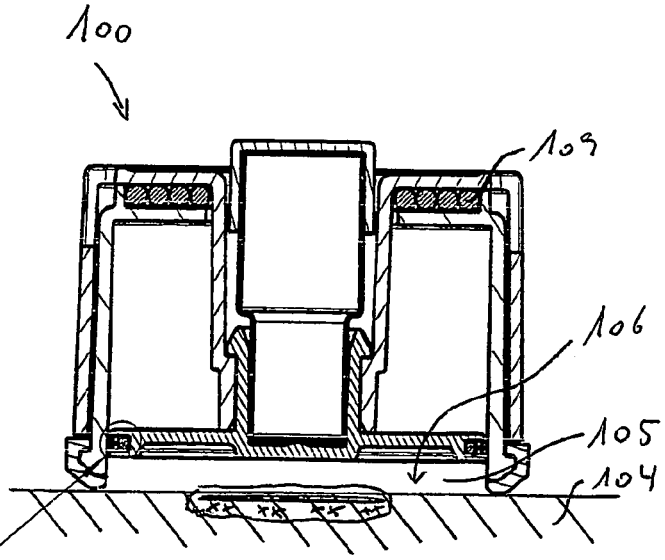
Figure 1D:
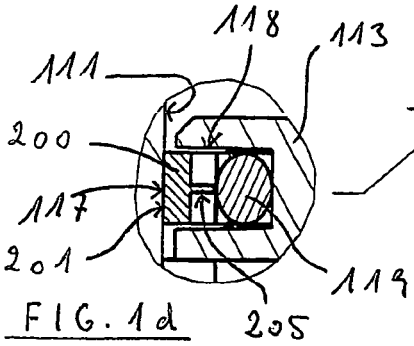
Figure 2B:
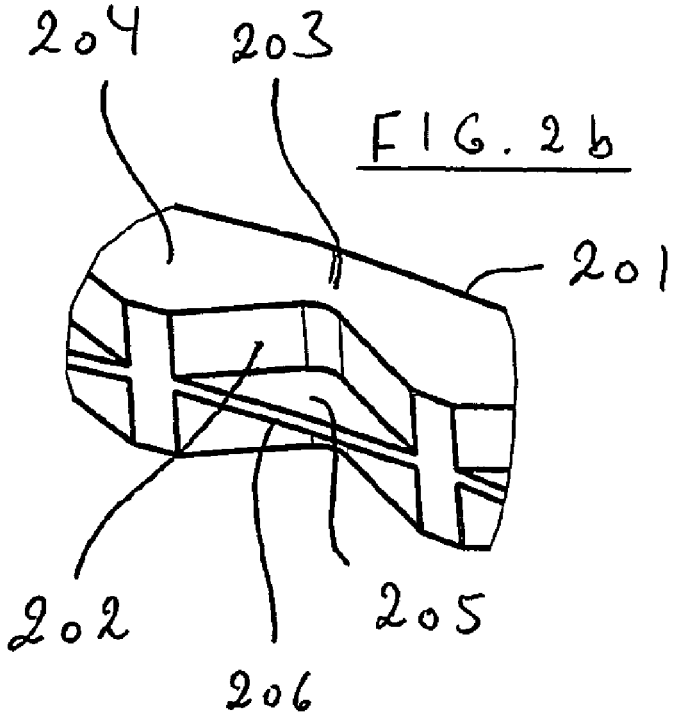
Figure 2A:
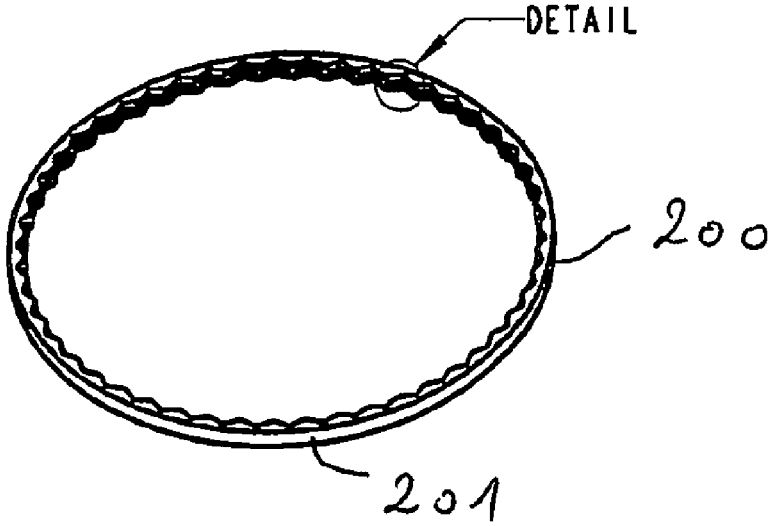
Figure 3A:
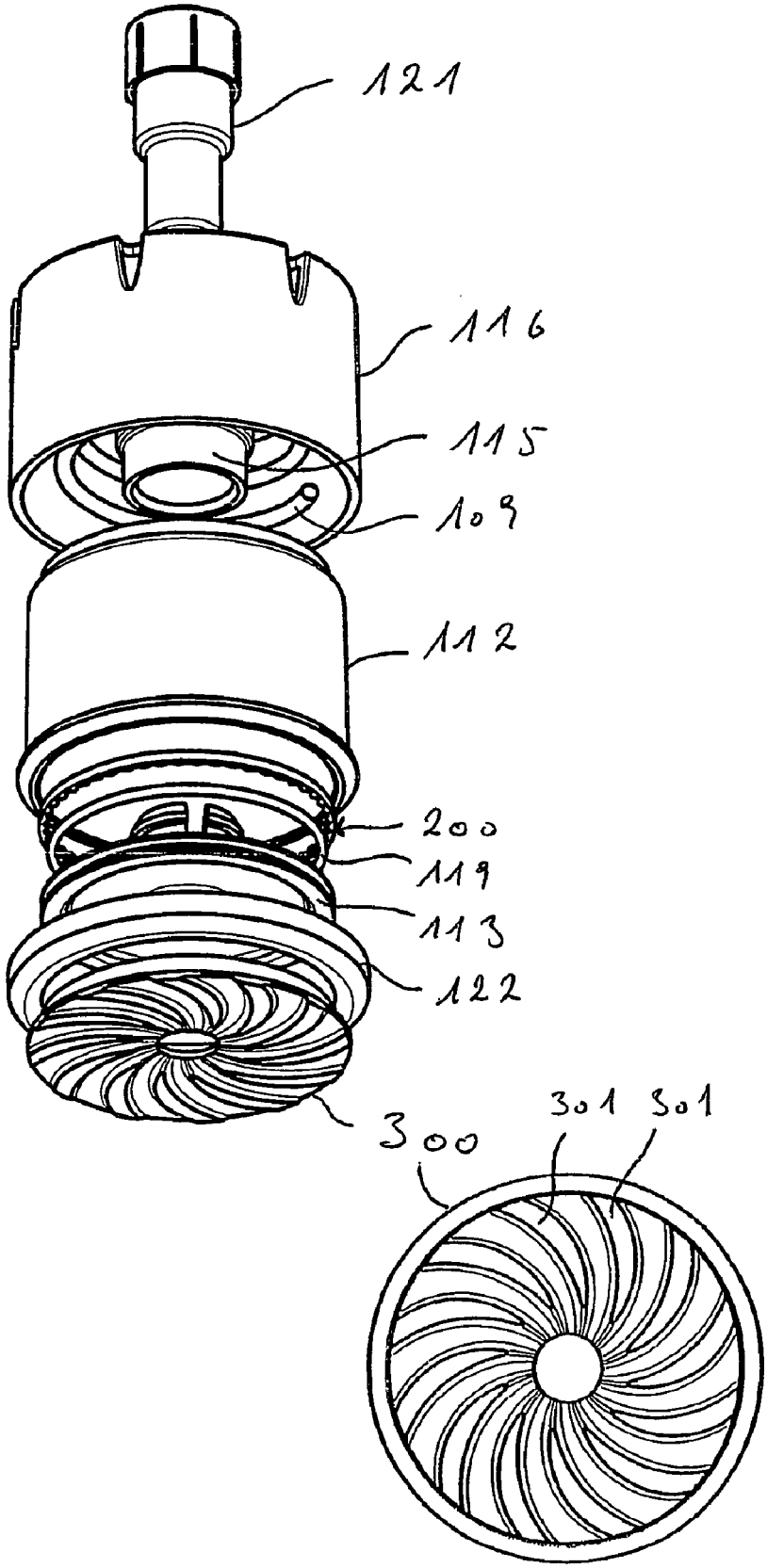
Figure 3B:
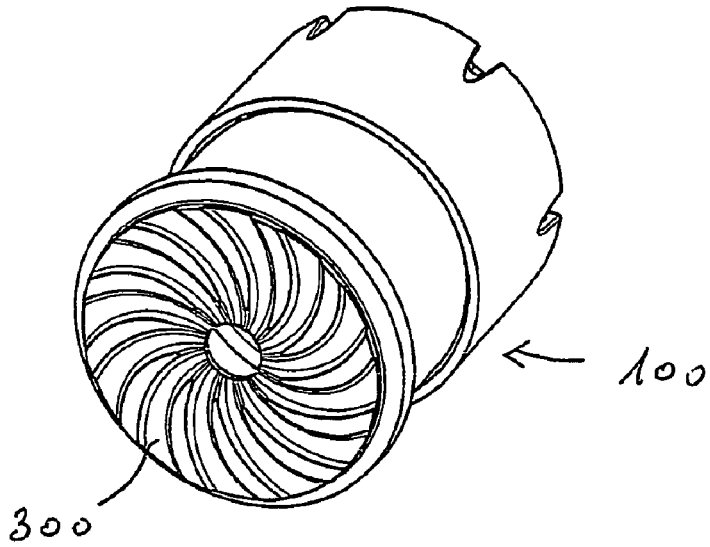
Figure 3B:
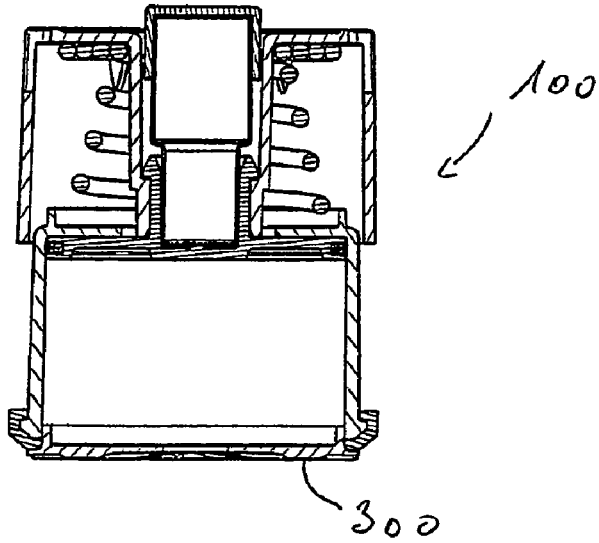
Figure 3B:
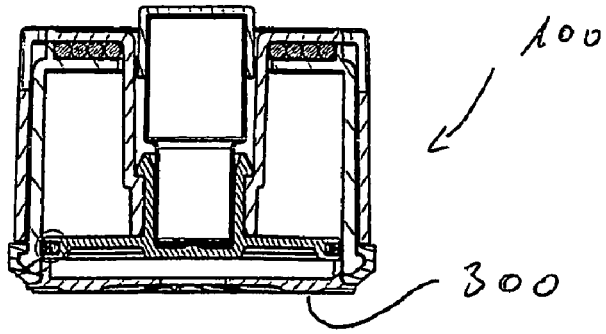
Figure 4D:
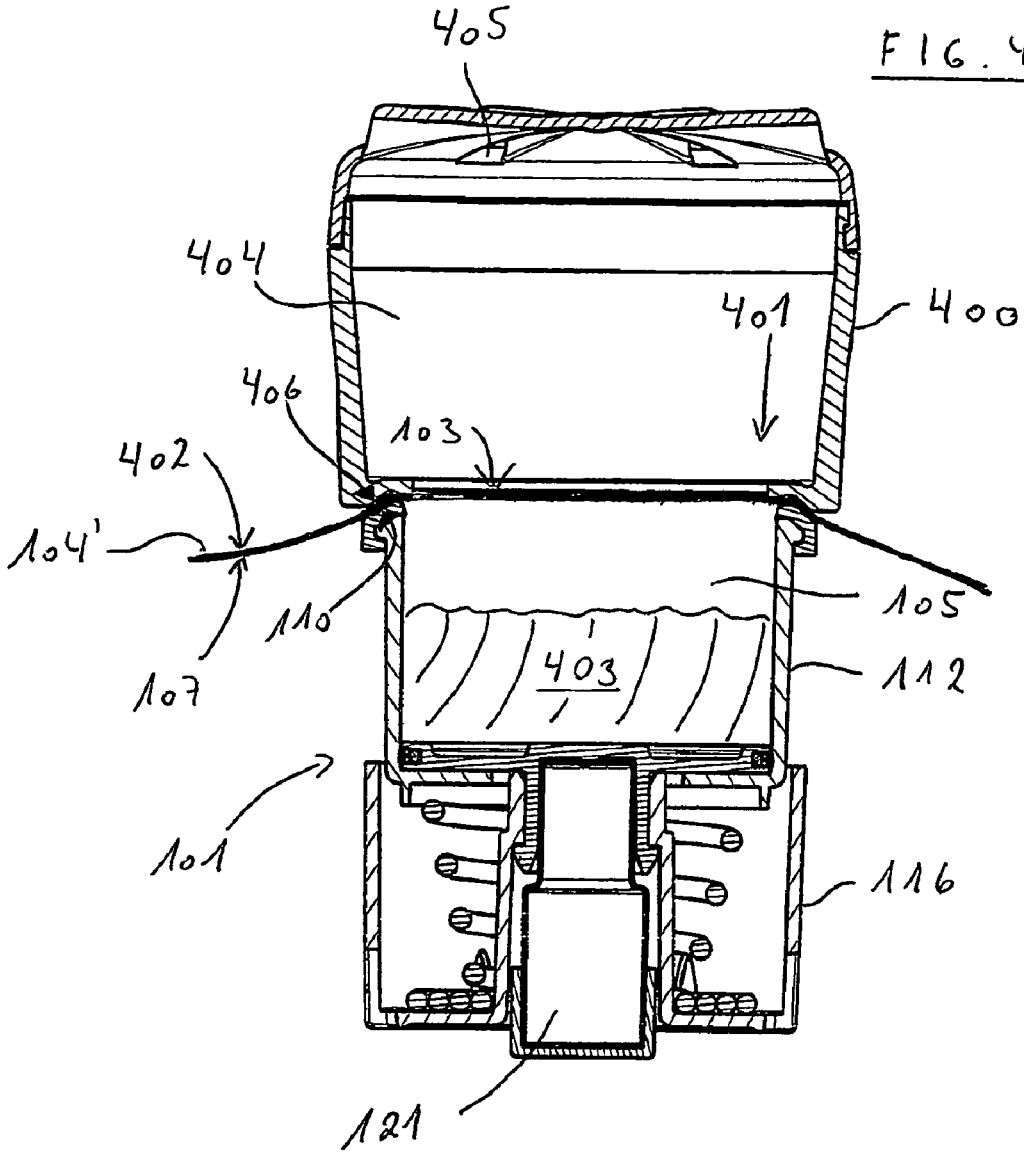
Figure 4D:
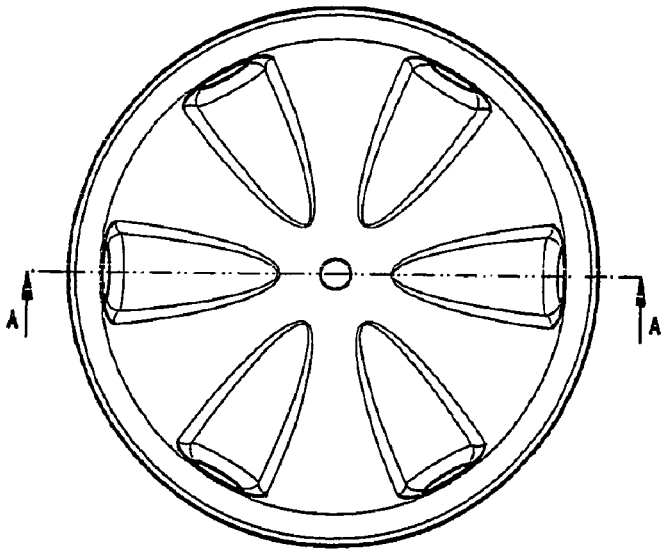
Figure 5:
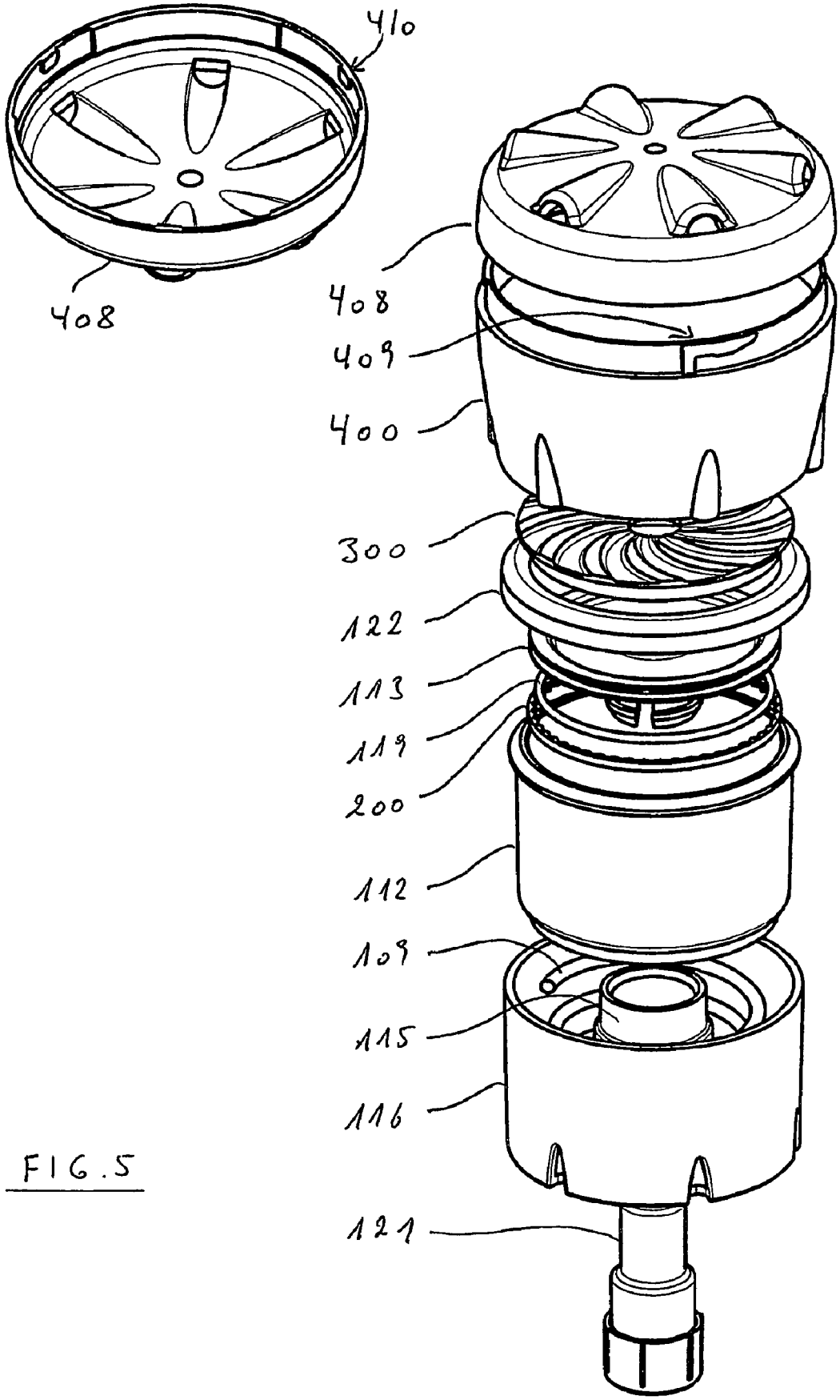
Figure 6:
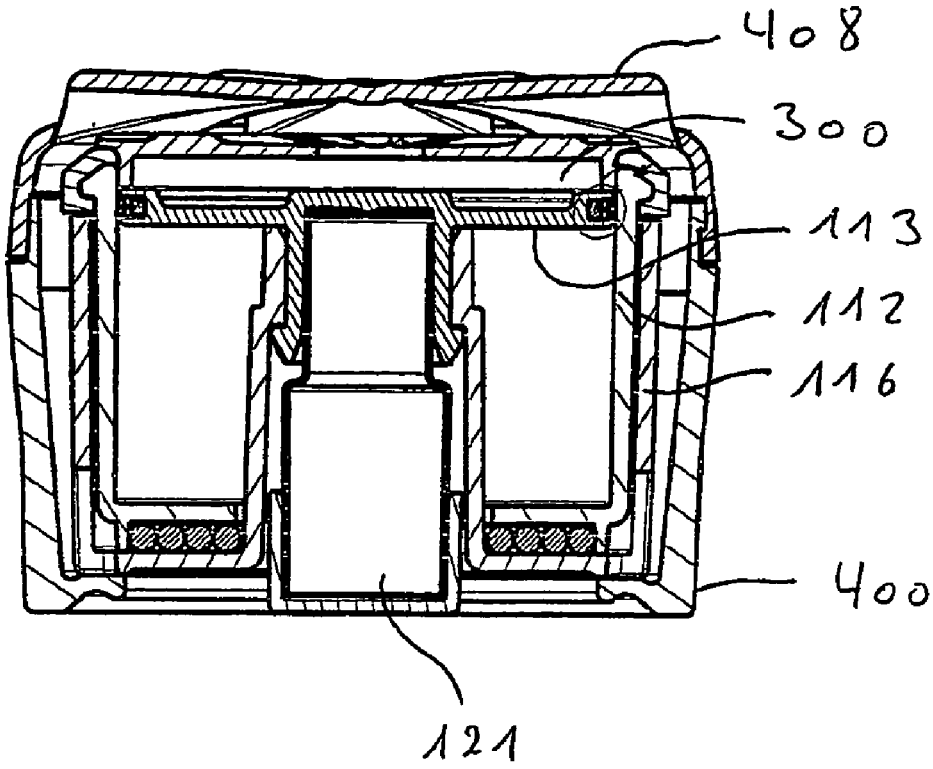
Figure 7:
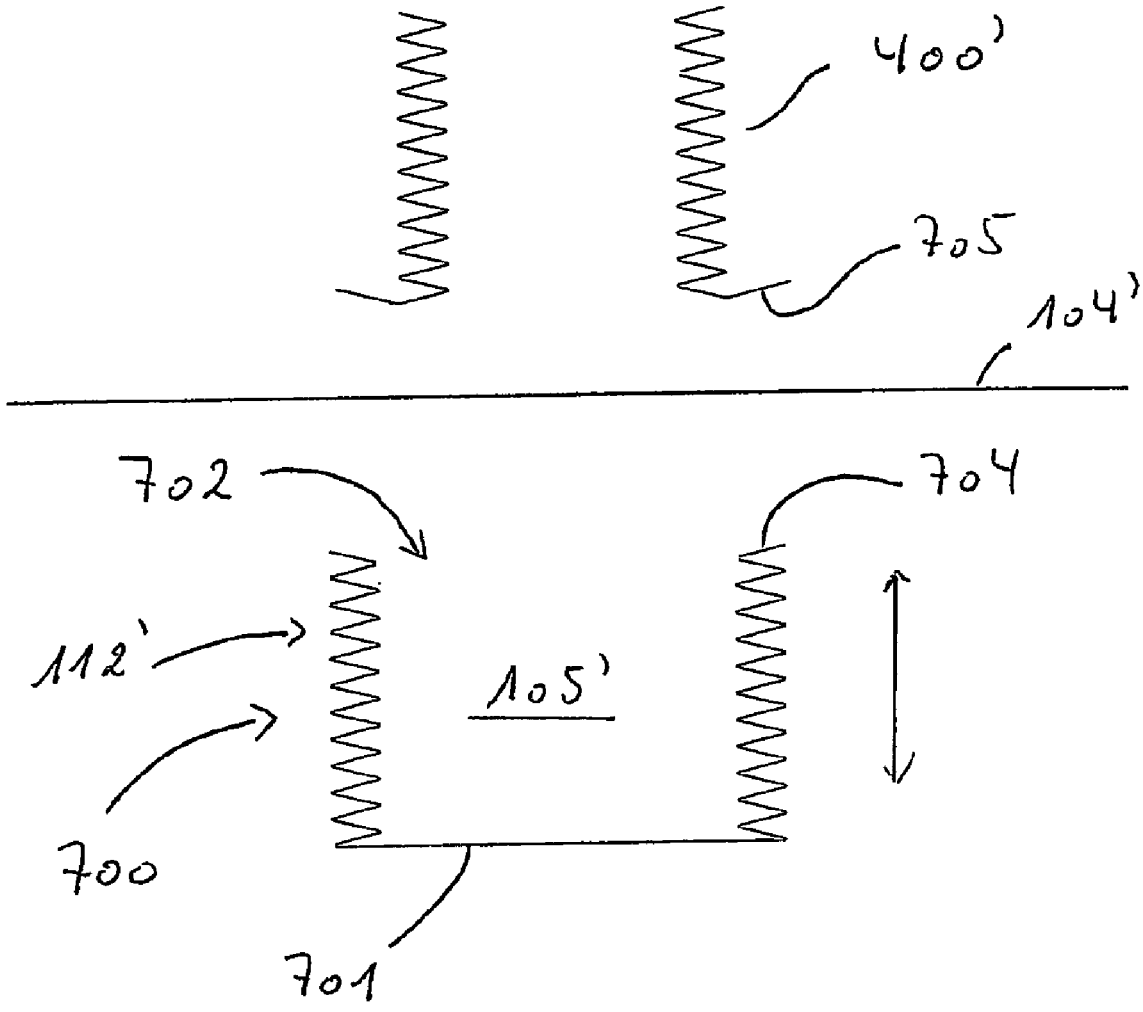

The invention will be explained in more detail with reference to the drawing, where FIG. 1 is a drawing of a first embodiment of the apparatus according to the invention, FIG. 2 is a drawing of the PTFE-ring in a detailed view, FIG. 3 is a more detailed sketch of the first embodiment, FIG. 4 is a drawing of a second embodiment of the apparatus, FIG. 5 is an exploded view of the second embodiment, FIG. 6 is a drawing of the apparatus in a compact state, FIG. 7 is a drawing of an alternative simple embodiment of the invention.

DETAILED DESCRIPTION OF THE INVENTION

FIG. 1 illustrates an apparatus 100 according to a first embodiment of the invention, where FIG. 1*a* is a side view of the apparatus 100, FIG. 1*b* is a vertical cross section of the shown apparatus 100 in a deactivated state, and FIG. 1*c* is a vertical cross section of the apparatus 100 in a compressed state.

The apparatus 100 comprises a manually driven pump 101 for pumping a cleaning substance 102 through a local area 103 of the material porous 104 to be cleaned. The pump 101 comprises a first reservoir 105 with an opening 106 for communication with the local area 103 of a first side 107 of the material 104. The reservoir 105 has a first volume in a deactivated state of the pump 101 as shown in FIG. 1*b*. The reservoir 105 is constructed with a variable volume for pumping of the cleaning substance 102 through the local area 103 of the material 104 upon manual activation of the pump in order to clean stains 108 from the material 104.

The first reservoir 105 has a boundary in a first reservoir-chamber 112, the boundary comprising a cylindrical or substantially cylindrical inner wall 111 of the first reservoir-chamber 112 and a piston 113 closely fitting to the inner wall 111, where a displacement of the piston 113 in the reservoir-chamber 112 varies the volume of the first reservoir 105.

The piston 113 is connected with a snap lock 114 to an extension 115 of the piston and connected to an outer housing 116. When the outer housing 116 is depressed towards the material 104, an elastic member in the form of a spring 109 arranged between the piston 113, 115 and the first reservoir-chamber 112 will be compressed and the outer housing 116 will move together with the piston 113, 115 towards the material 104. The compressed state after maximum compression is shown in FIG. 1*c*. As the first reservoir-chamber 112 is stationary with respect to the material 104, the volume of the first reservoir 105 will be decreased and air will be pressed out of the opening 106.

The apparatus 100 as illustrated may be used for cleaning in the following way. Once a stain 108 or spot has been observed in the porous material 104, for example on the fabric of an arm chair or a carpet, a cleaning fluid 102 is put on the spot 108 as illustrated in FIG. 1*b*, and the apparatus 100 according to the invention is arranged to cover the stain 108 by resting the rim 110 of the opening 106 against the fabric 104, for example a carpet lying on the floor. A pumping action may now be performed by pressing the outer housing 116 towards the porous material 104 such air is pumped out of the first reservoir 105 and together with the cleaning fluid 102 into and through the porous material 104 as illustrated in FIG. 1*c*.

During compression, the spring 109, as illustrated in FIG. 1*c*, is compressed and the outer housing 116 receives the reservoir-chamber 112. When the manual pressure on the outer housing 116 is released, the spring 109 will expand again and the apparatus 100 will attain its original deactivated state. The expansion causes a pull back of air into the first reservoir 105 by which the cleaning fluid 102 is pulled back through the fabric 104. By pressing the cleaning 102 fluid back and forth through the fabric 104, the spot 108 is dissolved in the cleaning fluid 102 and removed together with the remains of the fluid 102. Especially, foam from the cleaning fluid may be produced by this action, which may improve the cleaning process.

In order to achieve a tight connection between the rim 110 of the first reservoir-chamber 112 and the porous material 104, the rim 110 may be constituted by a resilient collar fastened to the first reservoir-chamber 112.

The inner wall 111 of the first reservoir chamber 112 may be truly cylindrical. However, the piston 113 may be provided with an elastically fitting sealing 117 such that a perfect cylindrical wall is not necessary. Substantially cylindrical, in this case, means a shape which for practical purposes in connection with the piston 113 and an eventual sealing 117 appears cylindrical. As the reservoir-chamber 112 may be produced by injection moulding with polymers, it is of advantage that the inner wall 111 of the reservoir-chamber 112 is slightly conical, for example with a slope of 0.25 degrees, such that the chamber 112 easily can be released from the mould form.

In case that the inner wall 111 is not perfectly cylindrical but only substantially cylindrical, for example slightly conical due to the reasons mentioned above, the piston 117 may be equipped with a resilient sealing 117 for fitting closely to the inner wall 111 as illustrated in FIG. 1*d*.

The sealing comprises an inert, low friction sealing ring, which in the following will be called a PTFE-ring, though this is no limitation of the invention in any way and also covers other comparable materials including the preferred embodiment, being a blend of polytetrafluorethylen and polyoxymethylene-acetal-polymer—PTFE(POM).

The PTFE-ring is illustrated in greater detail in FIG. 2. The ring 200 has a smooth outer side 201 for abutting the inner wall 111 and an alternating thickness variation 202 in its longitudinal direction for easing the elastic change of length of the PTFE-ring. PTFE, is normally not very elastic as compared to rubber rings but may be preferred due to its low friction with the inner wall 111, its inert properties in connection with cleaning fluids 102 and due to its long lasting performance even after long time of dry storage. In order to achieve sufficiently elastic properties, parts 203 of the PTPE-ring are thin such that a certain stretching and compression of the PTFE-ring is possible. By having an alternating thickness such that the PTFE-ring has thicker parts 204 between the thin sections 203, it is assured that the PTFE-ring does remain in a groove 118 of the piston 113, as illustrated in FIG. 1*d*, without the risk of sliding out of the groove 118 under even intensive pumping action. A sealing 117 arrangement of the described embodiment is able to provide a fluid tight sealing at the bottom as well at the top of the first reservoir-chamber 112 even though the inner wall 111 has a slope of the order of 0.25 degrees.

Providing a sealing ring 200 with an alternating thickness has a further advantage. During production of such rings, which typically is injection moulding, the rings contract during cooling. By providing a ring with alternating thickness, the moulding material during cooling will rearrange evenly in the mould along the periphery such that the sealing ring 200 with alternating thickness can be produced with small tolerances. This is in contrast to the conditions of rings with non-alternating thickness that are injection moulded, where the material during cooling may flow more to that side of the mould where the hardening starts, resulting in a ring having large thickness differences between diametrically opposite locations.

The PTFE-ring 200 may in addition be supported in a groove 118 of the piston 113 by a resilient o-ring 119 exerting force on the PTFE-ring 200 in a direction towards the inner wall 111. As the PTFE-ring 200 is not as elastic as rubber or, for example, silicone, an o-ring 119 support of the PTFE-ring 200 combines the low friction, inert and tightening capabilities of the PTFE ring 200 with the resilient properties of a rubber o-ring 119.

As the PTFE-ring 200 has an alternating thickness, it may under some conditions occur that the sealing 117 is not completely tight between the PTFE-ring 200 and the o-ring 119 in the groove 117. An improvement may thus be achieved by providing a sealing ring 200 with a sealing lip 205 following the inner side of the sealing ring 200 along its longitudinal direction and abutting the o-ring 119. In order not to damage the o-ring 119, the lip 205 may be rounded at its edge 206 facing the o-ring 119.

The outer housing 116 as shown in FIG. 1*b* and in FIG. 3 in an exploded view may comprise a cavity 120 accessible from the outside of the housing 116. Such a cavity 120 may be used for containing a releasable container 121 for cleaning fluid, such that the apparatus 100 according to the invention constitutes a kit with the cleaning device and the necessary cleaning fluid, for example a fluid with enhanced foaming properties. The releasable container may be provided with a valve for release of cleaning fluid, the valve being activated by pressure, for example with a finger.

When foam is pressed through a porous material 104 during pump action, the flow of air and foam through the material 104 at the centre of the opening 106 may not be the same as the flow at the rim of the reservoir-chamber 112. In this case, it is useful to provide the opening 116 with a cover unit 300 as shown in FIG. 3*a* configured to sealingly cover the opening 116 of the first reservoir 105. The cover unit 300 is provided with apertures 301 for communication between the first reservoir 105 and the local area 103 of the material 104. The apertures 301 have a width that increases with distance from the centre of the cover unit 300. In this case, a flow is achieved through the material 104, where the central flow and the flow at the rim are of the same order. The shape and arrangement of the apertures 301 may be differently as shown in dependence on the desired flow characteristics.

A drawing of the apparatus 100 with the cover unit 300 is further shown in FIG. 3*b* in in cross-sectional view and in a perspective view illustrating that a vertical orientation of the apparatus 100 is not necessary.

It may be desirable that not only air and foam may be pressed through the material, for example a fabric, but it may as well be desirable to press water through the fabric in order to flush the cleaning fluid out of the material. Also, it may be desirable to press a larger amount of cleaning fluid, for example water with a grease dissolving agent, through the material. In these cases with reference to FIGS. 4*a* and 4*d*, it is of advantage that the apparatus 100 comprises a second reservoir-chamber 400 to be arranged on the opposite side 402 of the porous material 104', sketched by a dashed line in FIG. 4*c*.

The second reservoir-chamber 400 has an opening 401 for communication with the local area 103 at the opposite side 402 of the material 104' such that under compression of the pump 101, fluid 403 provided in the first reservoir 105 is pressed from the first reservoir 105 through the porous material 104' and into the second reservoir 404. The second reservoir-chamber 400 has apertures 405 for allowing escape of air from the second reservoir 404.

The rims 110, 406 of the openings 106, 401 of the first 112 and the second 400 reservoir-chambers are configured to mutually correspond for creating a fluid tight—or at least substantially fluid tight—connection between the first 400 and the second 112 reservoir chamber when the material 104' is placed between the rim 110 of the first reservoir-chamber 112 and the corresponding rim 406 of the second reservoir-chamber 400.

This embodiment may be used in the following way. Water 403 or a cleaning fluid containing a cleaning agent is filled into the first reservoir 105 having the opening 106 directed upwards as illustrated in FIG. 4*d*. The housing 112 with the filled first reservoir 105 may be placed on a platform, for example a table, preferably after removal of the container 121. A fabric or other porous material 104' is placed on the rim 110 of the opening 106 of the first reservoir 105 with the corresponding stain on the material 104' within the periphery of the rim 110. Then, the second reservoir-chamber 400 is placed on the upper side 402 of the porous material 104' with its rim 406 fittingly arranged on the rim 110 of the first reservoir-chamber 112. By now pushing the second reservoir-chamber 400 downwards, the liquid 403 from the first reservoir 105 is pressed through the porous material 104' and into the second reservoir 404. As the rims 110, 406 of the first 105 and the second reservoir 404 mutually correspond, a liquid tight connection is achieved in combination with the porous material 104'. The invention is therefore an easy-to-use cleaning apparatus.

The shown embodiment is further illustrated in the exploded sketch of FIG. 5. However, the cover unit 300 as shown in FIG. 5 is normally not placed between the first reservoir-chamber 112 and the second reservoir-chamber 400 in the embodiment and use as shown in FIG. 4*d*.

In order to achieve an optimum tight connection on both sides of the porous material, it may be of advantage—especially if the porous material is not very flexible—if the rim 110 of the first reservoir-chamber or the rim 406 of the second reservoir-chamber or both of them are provided with a resilient collar 122, as for example illustrated for the first reservoir-chamber 112 in FIG. 1*b*. In FIG. 4*b* and FIG. 4*c*, the apparatus is shown as seen from above and from below relative to the orientation of FIG. 1*b*.

In a further embodiment, as illustrated in FIG. 5, the second reservoir-chamber 400 having a detachable lid 408 is configured for storage conditions to receive the outer housing 116 enclosing the first reservoir-chamber 112. After receipt of the outer housing 116, the lid is attached to the second reservoir-chamber 400 again, for example using screwing means 409, 410 as also illustrated in FIG. 5.

The detachable lid may be constructed such as to comprise an additional chamber for containment of sewing equipment, for examples needles and threads or other convenient travel accessories, such as an cleaning agent, for example stored in small paper bags, in case that the releasable container 121 is not provided. This may be convenient for a travel-aid kit.

In a most simple embodiment, the pump 101 in an apparatus 100 according to the invention comprises a resilient bellow 700 closed in one end 701 and open at the other 702 end with a rim 704 for communication with the material 104'. In this case, the internal volume of the bellow 700 comprises a first reservoir chamber 112' containing a first reservoir 105'.

The bellow 700 is resilient such that the volume of the first reservoir 105' of the bellow 700 is decreases when the bellow 700 is compressed. In addition, a second reservoir-chamber 400' with a rim 705 configured to correspond with the rim 704 of the first reservoir-chamber 112' in order to achieve a fluid tight arrangement between the two reservoir-chambers 112', 400' and the porous material 104' placed between them. The second reservoir chamber 400' need not be a bellow, however, an embodiment where also the second reservoir-chamber 400' is a bellow has the advantage that the first 112' and the second 400' reservoir-chamber may be compressed to a flat compressed state, well suited for travel conditions. Especially, the second reservoir-chamber 400' may have dimensions that it can be placed inside the first reservoir-chamber 112'—however turned 180 degrees as compared to the shown orientation in FIG. 7.

In the case that the second reservoir-chamber 400' is a bellow, it may be preferred to perform the pumping action by manually pressing on the upper side of the rim 705. If it is desired to perform the pumping action by pressing on the second reservoir-chamber 400', the stiffness of this bellow preferably is larger than the stiffness of the bellow 700 constituting the first reservoir-chamber 112' in order not to compress the upper bellow too much when performing the manual pumping action.

Another simple embodiment is achieved in that the pump comprises a resilient polymer container having an opening for communication with the fabric or other sheet-like porous material. For example, such a polymer container may be constructed like rubber bellows from old acoustic horns.

The invention claimed is:

1. Apparatus for cleaning a material, said material being a fabric or other sheet-like porous material, said apparatus comprising a manually driven pump for pumping a cleaning substance through a local area of said material, the pump comprising a first reservoir with an opening for communication with a local area of a first side of said material, said reservoir having a first volume in a deactivated state of said pump, said first reservoir being constructed with a variable volume for pumping of said cleaning substance through said local area of said material upon manual activation of said pump, wherein said pump comprises an elastic member with a force acting on the first reservoir to attain said first volume in said first reservoir, wherein said first reservoir has a boundary in a first reservoir-chamber, said boundary comprising a cylindrical or substantially cylindrical inner wall of said first reservoir-chamber and a piston closely fitting to said inner wall, where a displacement of said piston varies the volume of said first reservoir, wherein said piston is equipped with a resilient sealing for fitting closely to said inner wall, said sealing comprising a an inert, low friction sealing ring having a smooth outer side abutting said inner wall and an alternating thickness variation in its longitudinal direction for easing the elastic change of length of said inert, low friction sealing ring.

2. Apparatus according to claim 1, wherein said inner wall is slightly conical.

3. Apparatus according to claim 1, wherein said inert, low friction sealing ring is a PTFE(POM)-ring.

4. Apparatus according to claim 1, wherein said sealing comprises a resilient o-ring exerting force on said inert, low friction sealing ring in a direction towards said inner wall.

5. Apparatus according to claim 4, wherein said inert, low friction sealing ring has a sealing lip following the inner side of sealing ring along its longitudinal direction and abutting said o-ring.

6. Apparatus according to claim 1, wherein said elastic member is arranged between said piston and said first reservoir-chamber for actuating said piston towards said deactivated state.

7. Apparatus according to claim 6, wherein said piston is connected to an outer housing, configured to be able to enclose said first reservoir-chamber under storage conditions.

8. Apparatus according to claim 7, wherein said outer housing comprises a cavity accessible from the outside of said housing.

9. Apparatus according to claim 8, wherein said cavity contains a releasable container for cleaning fluid.

10. Apparatus according to claim 1, wherein said apparatus comprises a cover unit configured to sealingly cover said opening of said first reservoir, said cover unit having apertures for communication between said first reservoir and said local area of said material, said apertures having a width that increases with distance from the centre of said cover unit.

11. Apparatus according to claim 1, wherein said apparatus comprises a second reservoir-chamber with an opening for communication with said local area at the opposite side of said material, said second reservoir-chamber having apertures for allowing escape of air from said second reservoir chamber, wherein the rims of the openings of said first and said second reservoir-chambers are configured to mutually correspond for creating a substantially fluid tight connection between the first and the second reservoir chamber when said material is placed between said rim of said first reservoir-chamber and said corresponding rim of said second reservoir-chamber.

12. Apparatus according to claim 11, wherein said rim of said first reservoir-chamber or said rim of said second reservoir-chamber or both of them are provided with a resilient collar.

13. Apparatus according to claim 1, wherein said pump comprises a first resilient bellow closed in one end and open at the other end for communication with said material, said internal volume of said first bellow comprising said first reservoir.

14. Apparatus according to claim 13, wherein said apparatus comprises a second bellow with a second reservoir-chamber with an opening for communication with said local area at the opposite side of said material, said second reservoir-chamber having an aperture for allowing escape of air from said second reservoir chamber, wherein the rims of the openings of said first and said second reservoir-chambers are configured to mutually correspond for creating a substantially fluid tight connection between the first and the second reservoir chamber when said material is placed between said rim of said first reservoir-chamber and said corresponding rim of said second reservoir-chamber.

15. Apparatus according to claim 1, wherein said pump comprises a resilient polymer container having an opening for communication with said fabric or other sheet-like porous material, said internal volume of said polymer container comprising said first reservoir.

16. Apparatus for cleaning a material, said material being a fabric or other sheet-like porous material, said apparatus comprising a manually driven pump for pumping a cleaning substance through a local area of said material, the pump comprising a first reservoir with an opening for communication with a local area of a first side of said material, said reservoir having a first volume in a deactivated state of said pump, said first reservoir being constructed with a variable volume for pumping of said cleaning substance through said local area of said material upon manual activation of said pump, wherein said pump comprises an elastic member with a force acting on the first reservoir to attain said first volume in said first reservoir, wherein said apparatus comprises a second reservoir-chamber with an opening for communication with said local area at the opposite side of said material, said second reservoir-chamber having apertures for allowing escape of air from said second reservoir chamber, wherein the rims of the openings of said first and said second reservoir-chambers are configured to mutually correspond for creating a substantially fluid tight connection between the first and the second reservoir chamber when said material is placed between said rim of said first reservoir-chamber and said corresponding rim of said second reservoir-chamber, wherein said second reservoir-chamber is configured for storage conditions to receive said outer housing enclosing said first reservoir-chamber.

17. Apparatus according to claim 16, wherein said second reservoir-chamber is provided with a detachable lid for in detached configuration to allow receipt of said outer housing and under storage conditions in attached configuration covering said received housing.

* * * * *